US005806514A

United States Patent [19]

Mock et al.

[11] Patent Number: 5,806,514

[45] Date of Patent: Sep. 15, 1998

[54] DEVICE FOR AND METHOD OF DIVE MONITORING

[75] Inventors: Markus Mock, Uster; Ernst Völlm, Kilchberg, both of Switzerland

[73] Assignee: UWATEC AG, Hallwil, Switzerland

[21] Appl. No.: 619,479

[22] PCT Filed: Aug. 31, 1994

[86] PCT No.: PCT/EP94/02895

§ 371 Date: May 30, 1996

§ 102(e) Date: May 30, 1996

[87] PCT Pub. No.: WO95/08471

PCT Pub. Date: Mar. 30, 1995

[30] Foreign Application Priority Data

Sep. 23, 1993 [DE] Germany ..... 43 32 401.0

[51] Int. Cl.[6] ..... A61M 16/00

[52] U.S. Cl. ..... 128/204.23; 128/201.27; 128/205.23; 128/204.18

[58] Field of Search ..... 128/201.27, 201.28, 128/204.18, 204.21, 204.22, 204.23, 204.26, 205.23, 202.22, 205.11

[56] References Cited

U.S. PATENT DOCUMENTS

| | | | |
|---|---|---|---|
| 4,876,903 | 10/1989 | Budinger | 73/865.1 |
| 4,882,678 | 11/1989 | Hollis et al. | 364/413.31 |
| 4,926,703 | 5/1990 | Budinger | 73/865.1 |
| 4,970,897 | 11/1990 | Budinger | 73/432.1 |
| 5,016,483 | 5/1991 | Budinger | 73/865.1 |
| 5,049,864 | 9/1991 | Barshinger | 340/753 |
| 5,499,179 | 3/1996 | Sato | 128/201.27 |
| 5,503,145 | 4/1996 | Clough | 128/201.27 |
| 5,570,688 | 11/1996 | Cochran et al. | 128/202.22 |
| 5,617,848 | 4/1997 | Cochran | 128/205.23 |

FOREIGN PATENT DOCUMENTS

| | | | |
|---|---|---|---|
| B10550649 | 7/1993 | European Pat. Off. | B63C 11/32 |
| 2349128 | 11/1977 | France | G01D 1/00 |
| 8601172 | 8/1985 | WIPO | 128/205.23 |
| WO8601172 | 2/1986 | WIPO | B63C 11/32 |

*Primary Examiner*—Mickey Yu
*Assistant Examiner*—William J. Deane, Jr.
*Attorney, Agent, or Firm*—George W. Rauchfuss, Jr.

[57] ABSTRACT

Device for and method of dive monitoring, wherein the pressure in a diving flask of a breathing equipment and the ambient pressure which the diver is exposed to at the respective water depth are detected. A decompression computing means is used to determine the respective decompression stops which the diver has to observe in surfacing, and how much time surfacing will require altogether. A performance index is derived from the variation of the pressure versus time in the diving flask, which index is a measure of the physical work performed by the diver. This performance index is supplied to the decompression computing means and is considered in the calculation of the total surfacing period.

21 Claims, 3 Drawing Sheets

DEVICE FOR AND METHOD OF DIVE MONITORING

This application is a 371 of PCT/EP94/02895 filed Aug. 31, 1994,

The present invention relates to a device for and a method of dive monitoring, wherein the diver uses a breathing apparatus. Such a breathing apparatus commonly consists of one or two metal flasks which are disposed, for instance, on the diver·s back and which contain a highly compressed oxygen/gas mixture, which will be briefly referred to as "air" in the following, at a pressure of up to 350 bar, for instance. The breathing air is supplied to the diver by means of hoses via appropriate reducing valves.

As the water depth increases the higher becomes the hydrostatic water pressure, which acts upon the diver, with the result that the body tissue absorbs an elevated quantity of inert gases, particularly nitrogen. In order to prevent an excessively rapid release of these gases by the time of surfacing, which may lead to lasting injuries to health and even to death, divers rising to the surface again after a prolonged stay at rather deep underwater levels must make prolonged surfacing pauses in certain depths, which are referred to as so-called decompression stops or decompression halts. General survey of the decompression problems may be found in the book by A. A. Buehlmann: "Tauchmedizin" [*Diving Medicine*], Berlin-Heidelberg-New York, ISBN 3-540-52533-5. There the problems involved in decompression and the calculation of the decompression halts as a function of the dive profile are presented on pages 7 to 117.

In order to be able to determine the necessary decompression stops and their duration, as well as the resulting total surfacing time the divers use electronic diving computers nowadays, such as those which are marketed worldwide by Uwatec AG, Hallwil/Switzerland by the designations "Aladin" and "Aladin Pro". The structure of such a computer is described on pages 118 to 136 in Buehlmann's aforementioned book. This diving computer, which the diver wears at his wrist, determine the respective diving depth and the duration of stay, with an indication to the diver of the duration of the overall surfacing time as well as the levels and respective periods of the required decompression stops.

The document WO92/06889 discloses a device for monitoring a mobile breathing apparatus, wherein the air pressure prevailing in the diving flask is detected and the data is transferred to a computing means. The computing means determines firstly the time for which presumably the air supply will still be sufficient, and compares this time against the total time which is required for surfacing, inclusive of the decompression halts. The so-called remaining air time is then derived from these two time values, i.e. the time which the diver may still stay at the respective diving depth level before he commences to rise to the surface again.

The known diving computers have been designed predominantly for skin divers. If professional divers use such equipment, who work under water and who have to perform salvage, rescue or repair work, for instance, the decompression halts determined by the known equipment may be too short for enabling the diver to surface safely.

The present invention is therefore based on the problem of providing a device for and a method of dive monitoring, which are suitable for application also when the diver performs work under water.

In accordance with the present invention, this problem is solved by a device according to claim 1.

The inventive method is the subject matter of claim 14.

Improvements of the invention, which are to be preferred, are the subject matters of the dependent claims.

The inventive device or the inventive method make it possible to calculate the decompression halts, the total surfacing time and the remaining air time with a precision which is substantially better than this had been possible before.

When a diver performs underwater work the blood circulation in the body is intensified, particularly in the muscles performing the work. As a result, the tissue absorbs a quantity of inert gas in the same unit time, which is greater than in the case where the diver stays under water without performing work. With more inert gas being absorbed per unit time the decompression halts must be prolonged, which extends also the total surfacing time and hence reduces the potential time permissible for staying under water. In this respect attention should be drawn to the aspect that the term "work performed" should not be understood and considered only as work performed by the diver voluntarily. The diver may also be forced by external circumstances, too, to perform work e.g. when he reaches a strong flow and is required to perform strong swimming movements in order to maintain his position.

With the inventive method it is possible for the first time to determine the work performed by the diver during the dive, and to consider it in the calculation of the decompression halts.

In accordance with the invention this is achieved by the provision that a performance index is derived from the analysis of the air consumption, i.e. more precisely from the analysis of the pressure values of the diving flask as measured in succession, which index is a measure of the work performed by the diver by the respective point of time.

For the sake of a clear definition it should be noted in this context that the term "work performed" should be understood in the following in the physical sense of this term, i.e. as the work performed or as the energy converted per unit time.

It has been found that the air quantity inhaled by the diver permits the determination of the respective work output produced. A diver of average physical constitution and stature, staying under water substantially at rest, consumes approximately 8 liters of air per minute. At a 50 Watt work output the air consumption rises up to 22.5 liters/min already. In the case of strong physical work, e.g. by performing a specific operation underwater or due to a high swimming speed, the air consumption increases even further and may rise up to 70 liters/min at a work output of 200 Watt, which can be performed, as a rule, for a short while only.

In accordance with the invention, a performance index is determined on the basis of the flask pressure values as measured in a chronological succession, which is a measure of the physically performed work and which is then considered in the calculation of the decompression times.

In accordance with a first embodiment of the invention, which presents a particularly simple design, the work may be determined by a detection of the delay between the successive breathing cycles. Whenever the work performed by the diver is increased the diver must breathe in per unit time, e.g. per minute, more frequently than in a rest condition. The performance index is then derived from the respiratory rate, i.e. the number of breathing cycles per minute, for instance.

In an application of the method it should be noted that rapid breathing cycles, which are commonly termed hyperventilation, may occur also in the event of states of anxiety or panic. In such a case hence an unnecessarily prolonged total surfacing time constitutes the basis of the remaining air time calculation. Attention must be drawn to the fact, however, that the variation of the total surfacing time is "on the safe side" when hyperventilation occurs, which means that the total surfacing time is prolonged. When the respiratory rate is used to determine the performance index one should moreover consider the fact that when the work output is increased the respiration volume varies, too. The variation of the work performed is hence not proportional to the respiratory rate.

In a second embodiment the respective air quantity is calculated on the basis of the pressure values measured successively, which the diver inhales. Even though in states of anxiety and panic the respiratory rate is shortened very little air is inhaled in hyperventilation so that these states are not detected as high-performance conditions. In this embodiment, however, the aspect should be considered that the pressure-measuring means cannot determine the air volume output per unit time but merely the differential pressure before and after the breathing cycle. In order to be able to determine the air volume inhaled by the diver the flask volume must be known, too, in addition to the ambient pressure and the temperature.

Since diving flasks are available with various volumes the problem may be solved by adapting the device in its entirety, or the pressure gauge means only, to a specific flask volume. In the latter case the pressure gauge means then communicates an additional predetermined information, which is representative of the air volume, preferably together with the respectively measured pressure values or by the beginning or the end of measurement.

With the pressure gauge means being adapted for assembly on the flask separately of the remaining parts of the device, in a two-piece structure, the pressure gauge means may hence be fixedly connected to the flask so as to avoid any confusion.

As an alternative to the aforedescribed embodiment, input means may be provided, either on the pressure gauge means or on the remaining parts of the device, which the user employs to transfer an information about the respective volume of the diving flask to the device. This provision permits the potential application of the same device or the same pressure gauge means with different flask volumes. On the other hand, the aspect should be considered that any input error on the user's part results in the incorrect air consumption values and hence incorrect decompression values. For this reason, like in the other embodiments, it is recommended to perform an additional plausibility check.

In a preferred embodiment the performance index is determined by comparing the pressure values determined during a first interval with at least those pressure values which are determined during a second interval. The performance index is then derived from the variation of the measured pressure values between the first and the second or any following interval, respectively.

This approach entails the advantage that it permits an extremely precise determination of the performance index, without the necessity to know the diving flask volume. The device may hence be employed without any modification and thus also without any possibility of an error for various diving flasks.

In a first variant of this third embodiment the reduction of the measured pressure values is stored when the dive begins. These values are then assessed to be values representative of a small work performed. This approach is justified since the diver must perform only little work only when he enters the water.

The differential pressure values as measuring during this interval are equalled to a certain air consumption, e.g. a consumption of 20 liters/min. The volume of air inhaled when work is performed may then be determined on the basis of the comparison of the measured pressure values.

In a second preferred variant of the third embodiment, which will be referred to as fourth embodiment in the following, the performance index is derived by analysing the variations of the difference of the successively measured pressure values. It has been found that the air volume inhaled during a unit time becomes the more uniform the higher is the air volume inhaled and hence the work performed. In the device hence the magnitude of the variations of successively measured pressure values is determined, and then the relative variation of the amplitude, i.e. the variation of the amplitude relative to the respective absolute value, is derived therefrom. The performance index may then be derived from this value.

When the inventive method is realized—and this applies equally to all embodiments discussed here—it should be noted that the air volume inhaled by the diver depends not only on the absolute value of the measured pressure or the difference between two absolute values, respectively, but also on the ambient pressure and on the temperature of the air contained in the flask. For this reason, the respective ambient pressure, i.e. the hydrostatic water pressure prevailing at the respective diving depth, which is composed of the water pressure as such and the air pressure loading it, and the temperature of the air contained in the flask should be considered.

The inventive device may have a one-piece or two-piece structure in all the embodiments mentioned above.

In the case of a two-piece structure, the pressure gauge means is disposed on the diving flask and transfers a pressure gauge signal to a receiving means disposed at a remote position, e.g. on the diver's wrist or on the diver's mask. The measured values may be communicated from the pressure gauge means to the receiving means either by radio, i.e. by electromagnetic waves or ultrasound, or the two units may be connected by a cable.

In the case of a one-piece design the device is connected to the flask via a high-pressure hose. In that case the device is connected to the flasks, e.g. with integration into a common panel, and then grasped by the diver's hands for reading.

The invention will now be described in details with reference to the annexed drawing wherein.

Figure 1:
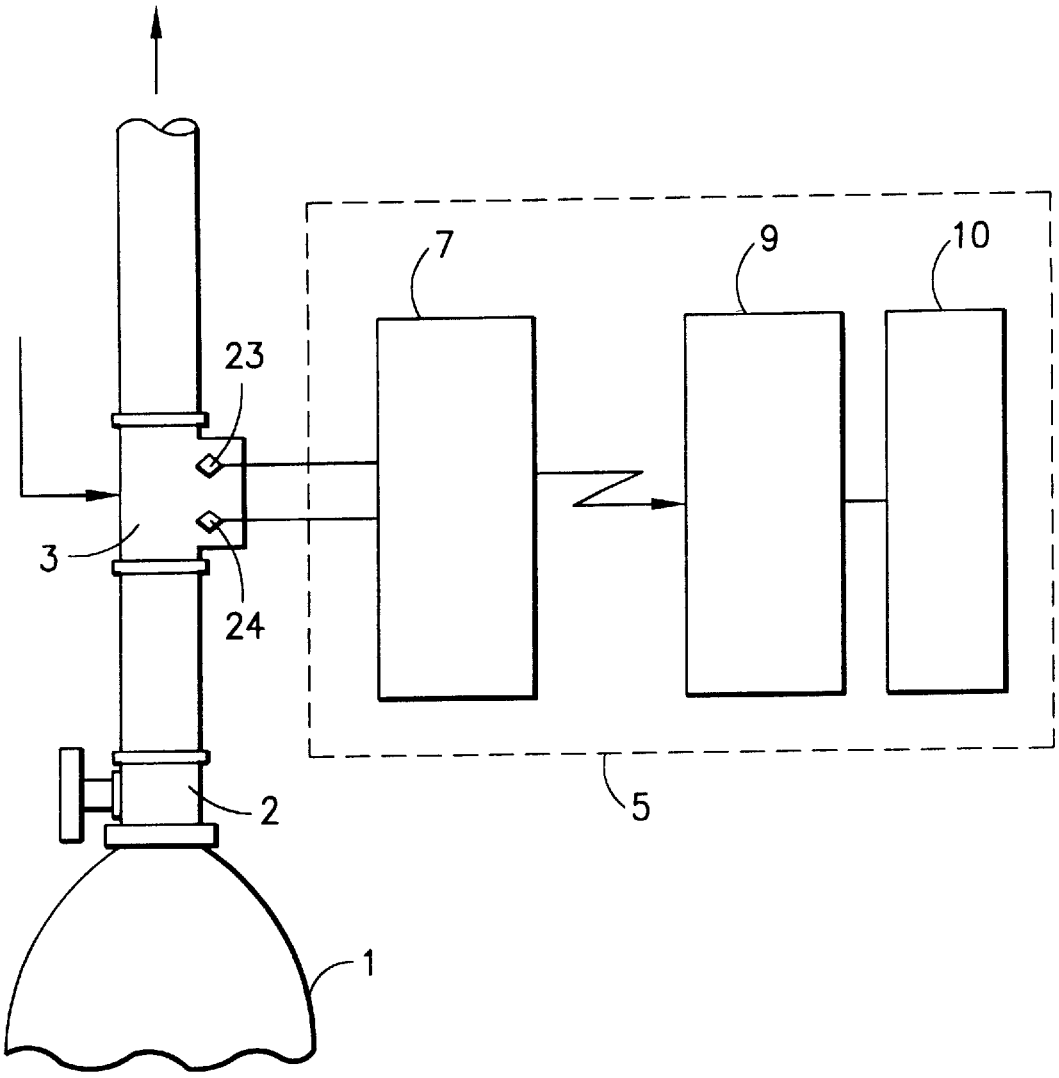
FIG. 1 is a block diagram of the inventive dive monitoring device.

The aforedescribed four embodiments will be explained in more details in the following, with reference to the drawing.

FIG. 1 is a highly schematic view illustrating the principal arrangement and structure of the inventive device.

The diving flask 1, which is illustrated only partly, is a conventional steel or aluminium flask having a volume of 7 to 18 liters, for example, and a maximum storage pressure, e.g. of 350 bar, which is to be closed by a manually operated shut-off valve 2. The flask pressure is reduced to the level required for the diver by an automatically operated pressure regulator 3, which is commonly termed demand oxygen regulator.

The device according to the present invention, which is indicated by numeral 5 in its entirety, comprises a pressure gauge means, generally identified by numeral 7, which measures the pressure in the high-pressure section of the breathing apparatus by means of a pressure transducer 23 and generates a transmitted signal, on the basis of the value so measured, which is then transmitted by radio to a processing means 9 via an antenna by means of electromagnetic radio waves. The signal is processed in the processing means 9 and then processed in a computing means. The result of the computation is indicated to the diver in a display 10. In addition to the display 10, alert lamps such as light-emitting diodes or acoustic alarms may be provided, too.

In a chamber of the reducing valve 3, which is in fluid communication with the interior of the diving flask, a pressure transducer 23 and a temperature detector 24 are provided. The signals of these detectors are transferred to a microprocessor 28 via a signal processing means 26 (cf. FIG. 2)

The microprocessor 28 includes a memory 30 including a first memory section S1, which stores a program for microprocessor control, as well as second, third to n-th memory sections S3-SN for storing data detected during the dive.

The pressure gauge means moreover includes a timer 32 supplying a fixed timing cycle, a signal processing means 34 for processing a signal output by the microprocessor 28 and for transferring it to an antenna 36, as well as a battery 38 for power supply of the pressure gauge means.

Details of the transmission procedure, particularly in terms of the manner in which the signal is processed, of the use of an identification signal suitable to prevent faultydata transmissions, are described in the aforementioned document W092/06889, specifically in the passage from the bottom of page 15 to the top of page 36. The disclosure of that document in this sphere is incorporated into the disclosure of the present application by this reference.

Figure 3:
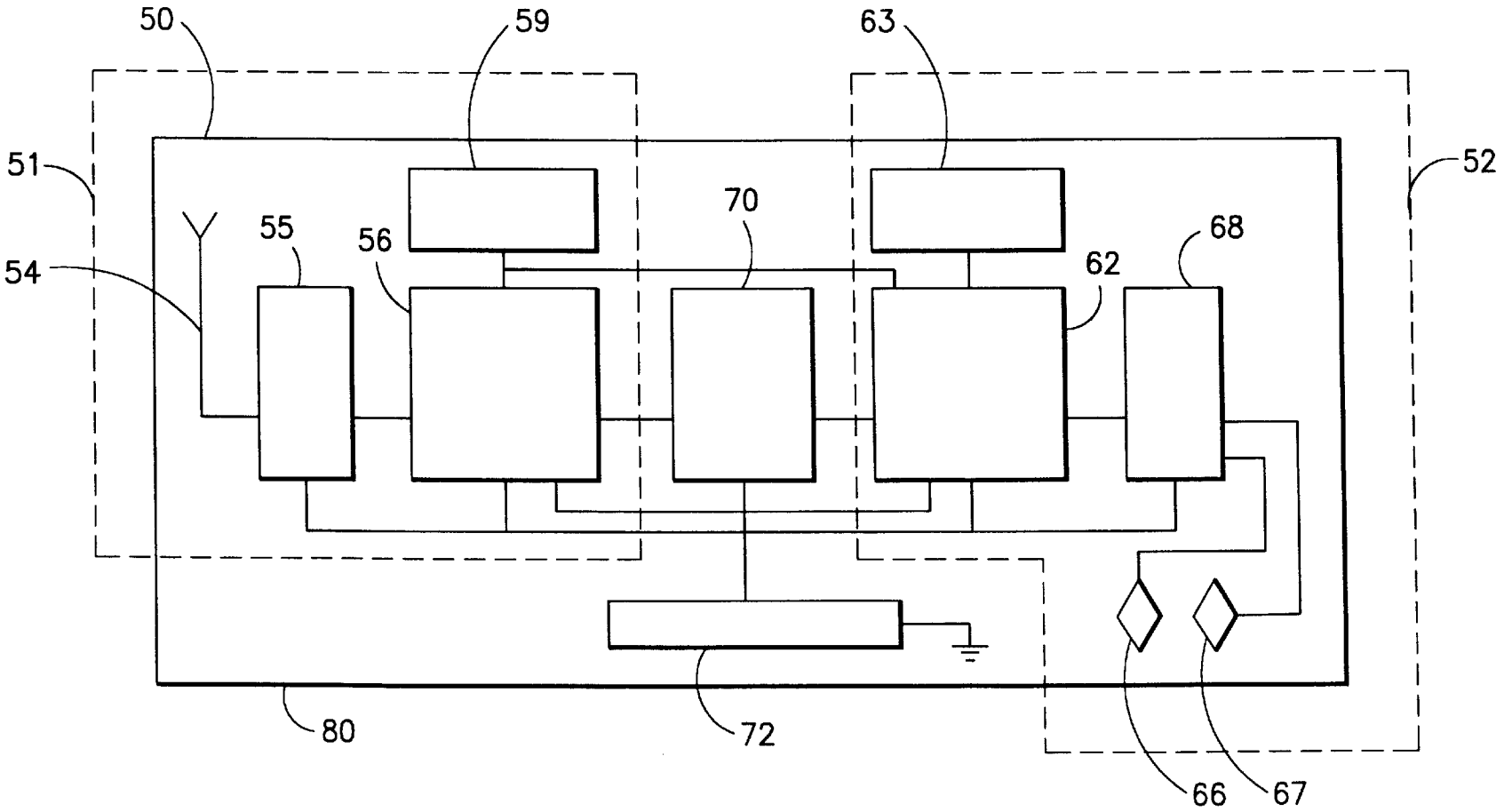
FIG. 3 shows an embodiment of a processing means in the inventive device.

The computing and display means 50, which interacts with the pressure gauge means and, together with the latter, constitutes the inventive device, is illustrated in FIG. 3.

The means 50, referred to as processing means in the following, comprises two sub-sections which are illustrated in dotted lines, specifically a first section 51 where the signal received from the pressure gauge means is received and processed, and a second section 52 where the total surfacing time, the decompression stops and the remaining air time are computed.

The receiving section 51 includes an antenna 54 which receives the signal transmitted by the pressure gauge means, and a signal processing means 55 connected to a microprocessor 56 referred to as second microprocessor in the following.

A timer 59 predetermines a fixed timing cycle for the entire processing means.

The decompression computing means is supplied with data from the microprocessor 56 and includes a microprocessor 62 which will be referred to as third microprocessor in the following.

The third microprocessor 62 is controlled by a program which is stored in a memory 63.

The third microprocessor 62 is connected to a detector 66 and a detector 67 which serve to measure the ambient pressure and the ambient temperature and to supply the measured values, via a signal processing means 68, to the third microprocessor means 62. The water depth is derived from the ambient pressure which corresponds to the hydrostatic pressure prevailing at the respective diving depth.

The results so calculated are indicated in a display 70 which is preferably an LCD display. This display is suitable to indicate both figures and symbols so as to provide the diver with a general survey of the respective data in relation to the respective dive.

A battery 72 is provided as power supply of the processing means.

The battery 72, like the battery 38 of the pressure gauge means, is a lithium cell whose energy is sufficient for many years of operation.

Both the pressure gauge means and the processing means are accommodated in a water-tight housing 40 or 80, respectively, which is completely filled with oil, a gel or any other medium suitable to this end.

The housing 80 of the processing means 50 may be so designed that it may be worn on the wrist directly, like any conventional diving computer.

It is also possible, however, to provide this means in another manner and to dispose only the display on the diver's wrist or in the region of the diver's mask so that the diver may always keep the display instruments in view.

The following is now a description of the function of the first embodiment with reference to the figures:

According to the first embodiment the performance index is derived from the measured respiratory rate.

The pressure in the flask is measured to this end in the pressure gauge means at short intervals, spaced from each other by 0.2 seconds, for instance.

As soon as a measured pressure value $p_i$ varies from the previously measured pressure value $p_{i-1}$ by a predetermined value whose order corresponds to or is slightly smaller than the order of the differential pressure of one breath a counting quantity K is incremented by the value of 1. This counting is performed over a predetermined interval, e.g. for 30 or 60 seconds, respectively, under control by the timer 32 and the microprocessor 28.

The respiratory rate so measured is then transmitted via the antennae 36 and 54 to the processing means 50. In the case of a low respiratory rate it is presumed that the diver produces only a small work output whereas in the event of a high respiratory rate a high work performance is presumed. A plurality of reference values is stored in the memory 63 of the processing means, with a specific performance index at a defined respiratory rate value being defined for each of these reference values. Appropriate values may be obtained, for instance, by way of experiments on a dynamometer, as will be discussed in the following. The performance index is considered by the decompression computing means in the calculation of the required decompression stops and the total surfacing time.

Based on the measured pressure values so detected and transmitted then an estimate is performed in the processing means 50 to determine how long the respiratory air will still be sufficient. This is done by detecting the time required until the pressure in the flask will have been reduced to a predetermined level, e.g. 30 bar, on the condition that the air consumption is the same. This time interval is referred to as total diving time still available. Then the total surfacing time is then subtracted from this total diving time, with the difference then corresponding to the remaining air time, i.e. the time which the diver may still spend at the corresponding diving depth level before he begins to rise to the surface again.

In these calculations the compressibility of the air must be considered. As the water depth increases, at a constant respiratory volume, the greater is the air quantity which is taken out of the flask per breath. The consumption is therefore converted to the normal pressure at sea level in this and all the other embodiments.

For a calculation of the remaining air time the invention proposes the application of an iterative method which will be explained, by way of an example, in the following.

For instance, by the time of calculation the diver has stayed at a defined diving depth level for 30 minutes. The program now operates on the assumption that the remaining air time corresponds to an initially determined fixed value, e.g. of 40 minutes. A first decompression computation is now based on the assumption that the diver has spent at this diving depth level for 70 minutes. Based on these quantities then the period of the individual decompression stops and, with additional consideration of a maximum surfacing speed, the total surfacing time is derived therefrom which, in this example, is defined to be 25 minutes. The computed total diving time is hence 95 minutes. In consideration of the actual air consumption how the level of the residual pressure in the flask after expiration of this 95 minutes interval is now calculated. This value is compared against a predetermined value, e.g. 30 bar. When the residual pressure after 95 minutes so computed is lower than 30 bar the assumed remaining air time of 40 minutes was too long and the value is appropriately reduced for a first repetition of the computation, e.g. by 5 minutes. Subsequently the computation is performed again with the new assumed stay period of 65 minutes.

If, however, the computation furnishes the result that the flask pressure after expiration of this total period is higher than the predetermined value the remaining air time is prolonged, e.g. by 5 minutes, whereupon the computation is performed anew. This iteration is repeated until the difference between the assumed remaining air time and the actual remaining air time so determined is lower than a predetermined threshold.

For the consideration of the work performed in the computation of decompression the invention proposes the following approach:

In a decompression computation model as described in Buehlmann's aforementioned publication (cf. in this respect also the literature identified ibidem) the saturation and desaturation of 16 different tissue types is simulated. This model is based on the finding that the different tissues in the human body are enriched with inert gas at different rates. For this reason a discrimination is made between the tissues of the brain, the spinal cord, the kidneys, the heart, the skeletal muscles, the joints, the bones, as well as of the skin and fatty tissue. Whenever a physical work is produced the circulation in the muscles is intensified. This entails a necessarily increased heat dissipation on the skin and the blood circulation in the skin is increased, too. In the decompression calculation in accordance with the present invention the values of the tissue model, which relate to the saturation rates of the tissues of muscles and the skin, are increased in dependence on the performance index. With that, the intensified blood circulation, and the higher rate of inert-gas absorption caused thereby, is duly considered.

The display 70 indicates the reached diving depth, which is derived from the ambient pressure, the time elapsed since the beginning of the dive, the remaining air time and the total surfacing time as well as the first decompression stop in terms of diving depth and dive duration.

The second embodiment is distinguished from the first embodiment by the fact that in addition to the aforedescribed means an input means 42 and a display 44 are provided.

The input means 42 consists, for instance, of three switches whereof one switch has a plus function, the second switch has a minus function, and the third switch serves a check function.

When the check switch and the plus switch are operated together a value representing the volume of the diving flask, e.g. in liters, which is indicated in the display 44, is incremented stepwise whereas an operation of the check switch and the minus switch correspondingly decrements the displayed value of the volume.

The value so entered is stored in the memory 30 and referred to for the computation of the air consumption.

For the sake of completeness it should be mentioned here that this input means may also be disposed in the receiving means; in this case the display 70 may be used directly for display purposes.

The following provision may be made for achieving an additional safety function: the input of the flask volume is possible only when the pressure transducer 23 does not indicate overpressure. In this manner the input volume can no longer be changed as soon as the shut-off valve 2 is open.

This second embodiment operates as follows:

The volume taken out $\Delta V=\Delta p \cdot V_{SCUBA}$ is calculated on the basis of the absolute pressure value $p_{i-1}$ measured by the beginning of a unit time and of the absolute pressure value $p_i$ measured upon expiration of the unit time, and of the flask volume $V_{SCUBA}$, with due consideration of the air temperature and the ambient pressure. In this embodiment, the memory 58 stores a number of volume values per unit time with the appertaining performance indices. Based on the calculated air quantity which the diver has breathed in, a performance index is determined and considered by the decompression computing means.

In all other respects, here the functions equal those of the first embodiment.

Figure 2:
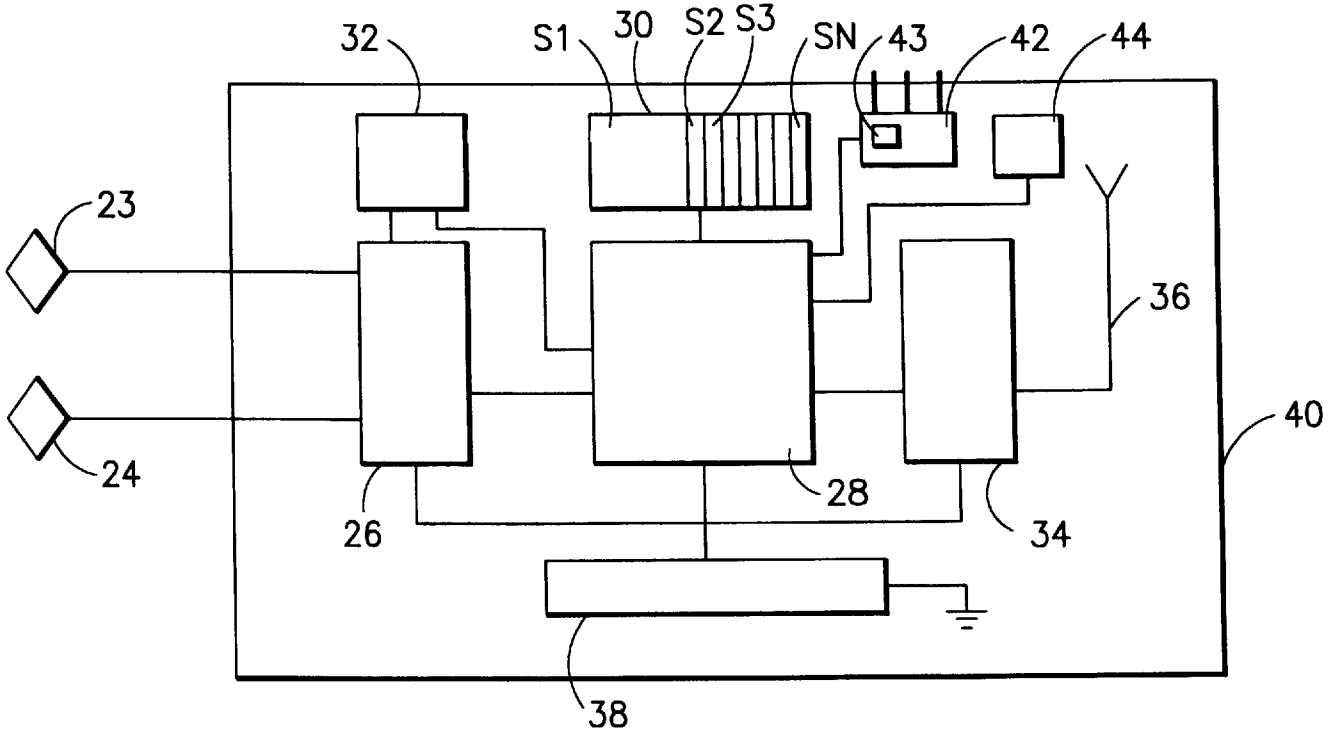
FIG. 2 is a schematic illustration of the pressure gauge means according to one embodiment of the inventive device.

In the third embodiment the pressure gauge means is designed as illustrated in FIG. 2 and as described with reference to the first embodiment, which means that the input means 42 and the display 44 are not provided.

The structure of the processing means corresponds to the illustration as explained by the example of the first embodiment and with reference to FIG. 3.

In that third embodiment, by the beginning of the dive, pressure values $\Delta p_i$, $\Delta p_{i+1}$ are measured at predetermined points of time $t_i$, $t_{i+1}$ which present a fixed delay from At with respect to each other. Based on these values, a statistical analysis is performed, e.g. by a weighted averaging method, for determining the mean pressure reduction $\Delta p_{avo}$ per unit time and storing same in the memory 63.

A certain predetermined air consumption, e.g. a consumption of 20 liters/min which corresponds roughly to a 50 Watt work performed by the diver, is assumed in the processing means for the value q=1, which means that the measured differential pressure value $\Delta p_i$ equals the average initial differential pressure value $\Delta p_{avo}$.

When the quotient q is increased a correspondingly higher air consumption is presumed. The performance index is then derived from the air consumption values so determined, via reference values stored in the memory 63 of the processing means, and then considered in the decompression calculation.

The fourth embodiment will now be described with reference to the Figures.

The structure of the pressure gauge means corresponds to the structure illustrated in FIG. 1 while here (like in the first and third embodiment) an input keyboard and a display are not provided in the pressure gauge means for entering the flask volume.

The pressure gauge means is controlled by the program stored in the memory 30 in a way that at intervals of 0.5 seconds each measured pressure values $p_i$ and measured temperature values $\sigma_{air,i}$ of the air are detected for forming an average value $P_{av}$ and $\sigma_{air,av}$. The averaging operation covers 40 values or 20 seconds. The measured mean values are transmitted via the antenna 36 to the receiving means every 20 seconds.

The value actually transmitted is compared in the receiving means against the value transmitted 20 seconds therebefore, and on the basis of the comparison the value $\Delta p_{av,i}=p_{av,i}-p_{av,i-1}$ is determined, with due consideration of the ambient pressure and the air temperature.

Moreover, the prevailing ambient pressure $P_{amb}$ is determined in the decompression computing means.

The air consumption within this interval of 20 seconds is then determined on the basis of the differential pressure $\Delta p_{av,i}$ and the ambient pressure $P_{amb}$, and in due consideration of the air temperature $\sigma_{air}$ the NPC (normalized pressure consumption) is determined which indicates the temperature-compensated consumption of "flask pressure" during this interval, converted to the normal pressure at sea level. Since the volume of the diving flask does not change during the dive this normalized value, i.e. the value free of any influence by ambient pressure and temperature, is proportional to the diver's air consumption.

A predetermined number x of successively detected NPC values is subjected to an averaging operation for computing therefrom the mean value $NPC_{av}$ of the pressure consumption for a predetermined interval, e.g. the last two, the last three or the last four minutes.

The consumption variation ΔNPC is then derived from the actually detected NPC value $NPC_i$, the actually detected average consumption $NPC_{av,i}$, the NPC value $NPC_{i-1}$ as determined in the preceding computing operation (i.e. 20 seconds earlier in this embodiment), and the average pressure consumption $NPC_{av,i-1}$ applicable for this value, and determined in accordance with the following formula:

$$\Delta NPC_i=|(NPC_{i-NPCi-1})-(NPC_{av,i}-NPC_{av,i-1})$$

Then a mean value $\Delta NPC_{av,i}$ is derived from a number x of measured Δp values and computed in accordance with the following equation:

$$\Delta NPC_{av,i}=((x-1)\cdot NPC_{av,i-1}+NPC_i)/x$$

The consumption index $C_{air}$ finally derives from the equation:

$$C_{air}=\Delta NPC_{av,i}/NPC_{av,i}$$

The performance index $C_{work}$ is then determined from this index, using appropriate reference values stored in the memory 63 of the processing means.

From the dive profile so far performed, i.e. from the time spent under-water so far at the respective diving depth levels, from the average value $NPC_{av}$, from the performance index $C_{work}$ and from an initially assumed still remaining time of stay at this diving depth level, i.e. the remaining air time, a computation is made as has been explained above to determine how much pressure will still be available in the flask upon expiration of the assumed remaining air time and the then required surfacing time. When the pressure is higher than a predetermined threshold—which is 30 bar in this embodiment—the assumed remaining air time was too short so that another longer remaining air time is assumed and the computation is hence repeated. This iterative computing operation is repeated until the variation from the assumed remaining air time and the actually computed remaining air time is within a predetermined range.

For a check of the method for its efficiency a series or dynamometer tests has been performed. Test persons breathing air from a conventional diving breathing equipment went through performance tests on a conventional bicycle ergometer with difference performance profiles. Using the method described above in relation to the fourth embodiment, the performance index was determined and compared against the performance actually produced by the test person, which was measured by means of a measuring device disposed on the dynamometer. These tests furnished a sound correspondence between the performance values determined in accordance with the method and the performance actually produced.

It could thus be demonstrated that a reliable computation of the performance is also possible when the diving flask volume, and hence the absolute value of the air quantity breathed in by the diver, is unknown.

In the aforedescribed embodiments two microprocessors, i.e. the second microprocessor 58 in the receiving section and the third microprocessor 62 are provided in the processing means. The functions of these two microprocessors may be combined also in a single microprocessor.

Moreover, in both a dual-microprocessor configuration and a single-microprocessor design the functions may be assigned and distributed among the pressure gauge means and the processing means in different ways.

For instance, more functions may be integrated into the pressure gauge means, e.g. the complete air consumption measurement and calculation with the corresponding microprocessor efficiency, but even less functions may be provided, too.

In a first extreme case all the functions such as air consumption measurement and decompression measurement are integrated into the pressure gauge means. The second unit, which is termed processing means, then includes still those elements only which are necessary for receiving data transmitted by the pressure gauge means and for indicating them on the display. Such a distribution is expedient if the display is to be integrated, e.g. into a diver's mask.

In the second extreme case the pressure gauge means comprises only those means which are necessary for detecting pressure measurement values and temperatures and for transmitting them to the processing means.

In all the aforedescribed embodiments a radio or wireless transmission technique is employed, such as the one described in the document WO92/06889. Instead of this method also a fixed cable connexion may be provided between the pressure gauge means and the processing means. The required cables may then be passed along the diver's body or integrated, as cable connexion, into the diving suit directly.

The functions of the pressure gauge means and the processing means may also be combined in a separate single device. In such a case the pressure gauge means is preferably not disposed on the flask directly but the pressure gauge means is rather disposed at a location remote from the flask and connected to the flask via a high-pressure hose.

The performance index is determined in the aforedescribed embodiments on the basis of a number of reference values stored in the form of tables with the respective input values. Instead, however, a mathematical function or any other arithmetic rule may be employed for determining the performance index from the input parameters such as respiratory rate, etc.

We claim:

1. A device for monitoring the dive of a diver, comprising:

a first pressure transducer which detects pressure in a diving flask of a breathing apparatus supplying the diver with breathing air;

a second pressure transducer which detects ambient pressure which is a measure of the water depth reached by the diver;

a timer serving to determine the time the diver has spent underwater;

a decompression computing means serving to compute, on the basis of time and ambient pressure values of said timer and said second pressure transducer, respectfully, which decompression stops the diver has to perform in surfacing and a total surfacing time;

a display means including a first display on which dive parameters may be indicated and which further comprises:

a memory means for storing pressure values as detected by said first pressure transducer in chronogical succession; and a second computing means for (1) deriving a performance index from the stored pressure values detected by said first pressure transducer, which index is a measure of physical work performed by the diver, and (2) supplying this performance index to said decompression computing means so that this performance index is utilized by the decompression computing means in computing the decompression stops and the total surfacing time.

2. A device according to claim 1, wherein the pressure values of said first pressure transducer are detectable at short intervals;

said second computing means can determine from the pressure values detected by the first pressure transducer how often the diver breathes during a preceding period, and can derive a respiratory rate of the diver therefrom; and said memory means stores a computing rule by which said performance index is derivable from the respiratory rate so derived or a plurality of respiratory rate reference values, with which a specific predetermined performance index is accociated, and said second computing means can select a next respiratory rate reference value from the derived respiratory rate for determining therefrom said performance index.

3. A device according to claim 1, wherein said second computing means can compute air consumption of the diver per unit time from the pressure values detected by the first pressure transducer and from a known predetermined volume of the diving flask;

said memory means stores a computing rule by which said second computing means derives said performance index from the air consumption of the diver per unit time; or a plurality of predetermined air consumption reference values, with associated performance indices, by which said second computing means determines the performance index from the computed diver's air consumption and these predetermined air consumption reference values.

4. A device according to claim 3, additionally comprising an input means by means of which the diver may enter a volume of the diving flask prior to the beginning of the dive, and a display in which the volume of the diving flask that may be entered is visible.

5. A device according to claim 4, wherein said input means includes at least one safety means for preventing potential inadvertent modification of said diving flask volume value so entered.

6. A device according to claim 1, wherein normalized pressure values detected by said first pressure transducer during a first interval are stored in said memory means and compared against normalized pressure values determined during at least one second interval, and said performance index is derivable from a comparison between the normalized pressure values detected during said first interval and from the normalized pressure values detected during said second interval.

7. A device according to claim 6, wherein said first interval is a period prior to the beginning of the dive;

a basic pressure consumption value is determinable from the pressure values detected during the first interval; and an actual pressure consumption value is determinable from the pressure values detected during a second and each of any successive interval, by a comparison against said basic pressure consumption value, and said performance index is derivable from said comparison.

8. A device according to claim 6, wherein a differential pressure value $\Delta NPC_i$ is determinable from a pressure value $NPC_{i-1}$ detected during a first interval and a pressure value $NPC_i$ detected in a next succeeding interval:

an average differential pressure consumption $\Delta NPC_{av}$ is determinable from these said pressure values as well as from a number of preceding pressure values; and the performance index is derivable from a variation of actual detected pressure value $\Delta NPC$ relative to said average pressure value $\Delta NPC_{av}$ for a number of successive pressure values $\Delta NPC_{i-2,i-1,i-}$.

9. A device according to claim 1, wherein said second computing means can determine normalized pressure values from the pressure values detected by said first pressure transducer and from the ambient pressure values detected by said second pressure transducer, which normalized pressure values are convertible to normal pressures at sea level and which are referred to as original parameters for determining the performance index.

10. A device according to claim 2, wherein said second computing means can determine normalized pressure values from the pressure values detected by said first pressure transducer and from the ambient pressure values detected by said second pressure transducer, which normalized pressure values are convertible to normal pressures at sea level and which are referred to as original parameters for determining the performance index.

11. A device according to claim 3, wherein said second computing means can determine normalized pressure values from the pressure values detected by said first pressure transducer and from the ambient pressure values detected by said second pressure transducer, which normalized pressure values are converted to normal pressures at sea level and which are referred to as original parameters for determining the performance index.

12. A device according to claim 6, wherein said second computing means can determine normalized pressure values from the pressure values detected by said first pressure transducer and from the ambient pressure values detected by said second pressure transducer, which normalized pressure values are convertible to normal pressures at sea level and which are referred to as original parameters for determining the performance index.

13. A device according to claim 1, wherein at least the first pressure transducer, the timer and a signal processing means are disposed in a first housing which is fastened on or in the vicinity of said diving flask;

a display means is disposed in a second housing remote from said first housing; and said device further comprises a data transmission means for transmitting data from the first housing to the second housing.

14. A device according to claim 9, wherein at least the first pressure transducer, the timer and a signal processing means are disposed in a first housing which is fastened on or in the vicinity of said diving flask;

a display means is disposed in a second housing remote from said first housing; and said device further comprises a data transmission means for transmitting data from the first housing to the second housing.

15. A device according to claim 13, wherein said data transmission means includes a transmitting means for receiving signals from the said first pressure transducer and transmits said signals via an antenna, and that in said second housing a receiving means is disposed which includes a second antenna for receiving the signals transmitted by said transmitting means and supplies said signals to said display.

16. A device according to claim 14, wherein said data transmission means includes a transmitting means for receiving signals from the said first pressure transducer and transmits said signals via an antenna, and that in said second housing a receiving means is disposed which includes a second antenna for receiving the signals transmitted by said transmitting means and supplies said signals to said display.

17. A device according to claim 13, wherein said first housing and said second housing are physically interconnected by said data transmission means, with said data transmission means capable of transmitting data electrically or optically.

18. A device according to claim 14, wherein said first housing and said second housing are physically interconnected by said data transmission means, with said data transmission means capable of transmitting data electrically or optically.

19. A device according to claim 1, wherein said decompression computing means and said second computing means are combined in one microprocessor means.

20. A method of monitoring a dive performed by a diver with mobile breathing equipment, including the following steps:

detecting the pressure values in an air supply tank of said mobile breathing equipment;

storing successively detected pressure values;

detecting an index of air consumption by the diver in a predetermined period of time;

with simultaneous execution of the following steps:

detecting ambient pressure around the diver and determining a diving depth at which the diver is staying;

computing the period for which the diver stays at said diving depth;

whereupon the following steps are performed:

determining a performance index from the detected index of air consumption, which is a measure of physical work performed by the diver during a specific period;

computing decompression stops and total surfacing time period in consideration of time for which the diver has stayed at the respective diving depth levels, and from the measure of physical work performed by the diver during his stay; and displaying on a display at least one index which is decisive for the decompression conditions.

21. A method according to claim 20, including the following further steps:

determining the time period for which the air supply will presumably be sufficient, on the basis of the detected pressure values in the air supply tank and a predetermined threshold defined for a minimum pressure value in said air supply tank;

subtracting from this determined time period the total surfacing time period computed to provide a differential time result; and displaying said differential time result as a period for which the diver may remain at a respective diving depth level while he continues production of work and air consumption.

* * * * *